US009180494B2

(12) United States Patent
Bernoussi et al.

(10) Patent No.: US 9,180,494 B2
(45) Date of Patent: Nov. 10, 2015

(54) SORTING MACHINE FOR SORTING FLAT ARTICLES ON EDGE, WITH ARTICLE BUNCHING BEING DETECTED

(71) Applicant: SOLYSTIC, Gentilly Cedex (FR)

(72) Inventors: Hicham El Bernoussi, Paris (FR); Agnes Philippe, Vincennes (FR); Celine Guignard, Issy les Moulineaux (FR)

(73) Assignee: SOLYSTIC, Gentilly (FR)

( * ) Notice: Subject to any disclaimer, the term of this patent is extended or adjusted under 35 U.S.C. 154(b) by 0 days.

(21) Appl. No.: 13/824,844

(22) PCT Filed: Dec. 28, 2012

(86) PCT No.: PCT/FR2012/053097

§ 371 (c)(1),
(2) Date: Mar. 18, 2013

(87) PCT Pub. No.: WO2013/114008

PCT Pub. Date: Aug. 8, 2013

(65) Prior Publication Data

US 2015/0008165 A1 Jan. 8, 2015

(30) Foreign Application Priority Data

Feb. 2, 2012 (FR) ..... 12 50991

(51) Int. Cl.
*B07C 1/04* (2006.01)
*B07C 5/342* (2006.01)
(Continued)

(52) U.S. Cl.
CPC ..... *B07C 5/3422* (2013.01); *B65H 3/124* (2013.01); *B65H 3/46* (2013.01); *B65H 5/023* (2013.01); *B65H 7/12* (2013.01); *B65H 2301/321* (2013.01); *B65H 2301/44514* (2013.01); *B65H 2701/1916* (2013.01)

(58) Field of Classification Search
CPC ..... B07C 1/04; B07C 5/342; B65H 3/12; B65H 3/46; B65H 7/12; B65H 7/125; B65H 2301/321; B65H 2701/1916
See application file for complete search history.

(56) References Cited

U.S. PATENT DOCUMENTS 3,504,911 A * 4/1970 Silverberg ..... 271/260
3,773,321 A * 11/1973 Burroughs ..... 271/260
(Continued)

FOREIGN PATENT DOCUMENTS

EP 0 598 641 A1 5/1994
FR 2 958 276 A1 10/2011
JP 01-236154 A 9/1989

OTHER PUBLICATIONS

French Search Report for French Application No. 12 50991, dated Oct. 23, 2012 with Partial English Translation.

*Primary Examiner* — Joseph C Rodriguez
(74) *Attorney, Agent, or Firm* — Sughrue Mion, PLLC

(57) ABSTRACT

A sorting machine (1) for sorting flat articles (2) on edge, which machine includes an upstream conveyor (10), and a downstream conveyor (30) that conveys the flat articles (2) by nipping them, the upstream conveyor (10) and the downstream conveyor (30) being separated by detector means (100) including an intermediate conveyor (20) provided with intermediate belts (22) that convey said flat articles (2) by nipping them, and that are associated individually with suction means (24, 25) pressing any flat article (2) against one or the other of said intermediate belts (22), image capture means (26) for capturing images of the bottoms of said flat articles (2) passing between the intermediate belts (22), and analysis and processing means (4) for analyzing and processing said images to detect any bunching of said flat articles (2).

13 Claims, 1 Drawing Sheet

(51) Int. Cl.

| | |
|---|---|
| ***B65H 3/12*** | (2006.01) |
| ***B65H 3/46*** | (2006.01) |
| ***B65H 5/02*** | (2006.01) |
| ***B65H 7/12*** | (2006.01) |

(56) References Cited

U.S. PATENT DOCUMENTS

| | | | | | |
|---|---|---|---|---|---|
| 4,360,108 | A * | 11/1982 | Logothetis | ..... | 209/598 |
| 4,733,226 | A * | 3/1988 | Kasuya et al. | ..... | 340/674 |
| 5,505,440 | A * | 4/1996 | Uematsu | ..... | 271/258.01 |
| 5,697,610 | A * | 12/1997 | Holmes et al. | ..... | 271/263 |
| 6,328,300 | B1 * | 12/2001 | Stefan et al. | ..... | 271/2 |
| 6,435,498 | B1 * | 8/2002 | Stefan et al. | ..... | 271/2 |
| 6,761,352 | B2 * | 7/2004 | Scicluna et al. | ..... | 271/153 |
| 7,835,540 | B2 * | 11/2010 | Philippe et al. | ..... | 382/101 |
| 8,091,885 | B2 * | 1/2012 | Conaway et al. | ..... | 271/104 |
| 8,218,813 | B2 * | 7/2012 | Bell | ..... | 382/101 |
| 8,480,072 | B2 * | 7/2013 | Samain et al. | ..... | 271/3.18 |
| 2009/0218751 | A1 * | 9/2009 | Kutzer et al. | ..... | 271/10.01 |
| 2012/0013065 | A1 * | 1/2012 | Ambroise et al. | ..... | 271/10.01 |

* cited by examiner

SORTING MACHINE FOR SORTING FLAT ARTICLES ON EDGE, WITH ARTICLE BUNCHING BEING DETECTED

TECHNICAL FIELD

The invention relates to a sorting machine for sorting flat articles on edge, which machine includes an upstream conveyor, a downstream conveyor that is provided with side downstream belts facing each other and that is arranged to convey the flat articles by nipping them, and detector means for detecting bunching of the flat articles.

For example, the flat articles are small-format mailpieces, such as letters, or large-format mailpieces, such as magazines.

Such a sorting machine makes it possible to put the flat articles into series and to transport them, e.g. between a flat article unstacker and one or other of the sorting outlets, at each of which the flat articles are stacked in compliance with a predetermined sorting plan.

In the field of sorting of flat articles, the term "single take" or "single feed" may be used to mean the situation when flat articles are being conveyed singly, i.e. without bunching, one behind another, and separated by gaps, and the term "multiple take" or "multiple feed" may be used to mean the situation when the flat articles are being conveyed overlapping in full or in part, i.e. are bunching, requiring special handling in order to avoid some of such overlapping articles suffering sorting errors and jams downstream in the sorting machine.

PRIOR ART

In known manner, the flat articles are disposed on edge, in a stack, in a magazine in which they are pressed against an unstacking plate. For example, the unstacking plate is provided with a belt suitable for moving the first flat article in the stack relative to the remainder of the stack. The flat articles are thus unstacked, one after another in an unstacking direction, and are then conveyed by a conveyor device towards sorting outlets. Under optimum operating conditions, the unstacked flat articles follow one another without mutually overlapping, i.e. without bunching and in single takes. However, it can happen that two successive flat articles overlap and thus form a bunch or "multiple take". In order to guarantee optimum downstream processing of the flat articles, it is then necessary either to separate the bunched flat articles of the multiple take, or to remove them for subsequently processing them again. In both of these cases, appropriately taking account of bunching, i.e. of multiple takes, requires such bunching to be detected and the bunched flat articles to be separated prior to any subsequent processing.

Devices for separating bunched flat articles are known. In particular, Publication U.S. Pat. No. 6,494,446 describes such a separator device that has a nip zone followed by two distinct suction belt paths, one enabling the processing of the flat articles to continue, and the other enabling the flat articles to be removed for subsequent processing. The nip zone is formed by side belts between which the flat articles are nipped in order to be conveyed. The distance between the side belts of the nip zone is regulated as a function of the thicknesses of the flat articles, the thickness of each flat article being determined by means of detectors provided upstream from the nip zone. When a flat article that can be more or less thick than the preceding flat article arrives at the entrance to the nip zone, the width of said nip zone is adapted to guarantee optimum nipping of the flat articles. In the event of bunching, once the multiple take has passed the nip zone, one of its flat articles is driven by suction by the first belt path towards the following processing zones, and the other is driven by the second belt path towards a removal tray. The bunching is thus eliminated and the removed flat articles can be re-processed subsequently.

Publication US 2009/0218751 also discloses a multiple-take separator device having a nip zone similar to the above-described nip zone and at which the speeds of advance of the drive belts are different, one of the belts being faster. Thus, in the event of bunching, one of the flat articles in the multiple take is driven by the faster belt, and the other is driven by the slower belt. However, that speed differential tends to generate a shear force making it possible to separate the bunched flat articles making up the multiple take. Unfortunately, it has been observed that there is a high risk of that shear force damaging fragile flat articles, in particular flat articles that are open or that are wrapped in plastic.

Other separator devices are known, such as the separator device described in Publication FR 2 958 276. That separator device has a tunnel defined by two suction belts provided facing each other at a distance greater than the combined thickness of two flat articles bunched together in a multiple take. Thus, under normal operation, each flat article arriving in the tunnel is pressed by suction against one or the other of the suction belts by which it is conveyed. In the event of bunching, one of the flat articles in the multiple take is pressed against a first suction belt, and the other is pressed against the second suction belt, so that they are separated laterally from each other while limiting the shear stresses to which the flat articles are subjected. The speed and the suction of each suction belt may be controlled so as thereby to offset one of the flat articles in the multiple take relative to the other one. In order to control the suction belts appropriately, that separator device is provided with detector means provided upstream from the suction belts and suitable for determining the arrival profile of the flat articles and for detecting any bunching. Those detector means are also coupled to measurement means for measuring the thicknesses of the flat articles, which means are also provided upstream from the tunnel, and make it possible to adapt the distance between the suction belts.

The above-mentioned separator devices make it possible to detect and then to handle bunching. In certain situations, it can nevertheless be advantageous to be able to use independent detector means that are not directly associated with the separator device and that make it possible to use technologies that are of lower complexity and of higher effectiveness. Any multiple-takes detected can then be removed to a specific outlet of the sorting machine for subsequent re-processing.

In addition to such separator devices, bunching detector means that are independent are also known. For example, and like the means described in Publication FR 2 891 168, such detector means include belts transporting the flat articles by nipping. A detection zone provided with lighting means and with a camera is provided under the passage zone through which the nipped flat articles pass. In that passage zone through which the flat articles are conveyed by nipping, their bottoms are not necessarily at the same height. Thus, in order to mitigate that problem, it is necessary to force the lighting means so that they reach the bottom of any bunched flat article that is situated higher up. It is also necessary for the depth setting of the camera and for the range of the associated lighting to enable such a flat article to be detected at a height different from the height of the bottom of the other bunched flat article in the multiple take. The image captured by the camera is then analyzed to determine whether bunching is occurring. However, as a function of the flat articles that are being processed, it is often difficult to detect bunching in reliable manner. This applies in particular for superposed postcards or thin coupons that are nipped together, the gap between such flat articles being small enough not to be detected. It is also difficult to detect that certain flat articles are traveling singly. This applies, for example, to flat articles containing a plurality of elements such as magazines or brochures wrapped in transparent plastic or indeed to certain printed covers of flat articles, the printing on such covers generating artifacts in their images that disturb detection of bunching. A flat article traveling singly being detected wrongly as being in a bunch causes it to be removed from the automatic sorting process for subsequent re-processing and is therefore costly.

SUMMARY OF THE INVENTION

An object of the invention is to remedy those drawbacks by proposing, by way of an alternative, a sorting machine that makes it possible to ensure that bunching is detected reliably and reproducibly so that such bunching can be handled effectively downstream from being detected.

To this end, the invention provides a sorting machine for sorting flat articles on edge, which machine includes an upstream conveyor, a downstream conveyor that is provided with side downstream belts facing each other and that is arranged to convey the flat articles by nipping them, and detector means for detecting bunching of the flat articles, said sorting machine being characterized in that the detector means are provided between the upstream conveyor and the downstream conveyor and include:

- an intermediate conveyor provided with perforated side intermediate belts facing each other and arranged to convey the flat articles without nipping them;
- suction means associated individually with the intermediate belts and suitable for generating suction at each of the intermediate belts, which suction is suitable for pressing any flat article traveling between the intermediate belts against one or the other of the intermediate belts;
- image capture means suitable for capturing images of the edges of said flat articles passing between the intermediate belts, the image capture means being disposed facing the passage zone defined by the intermediate belts, in the downstream portion of the passage zone; and
- image analysis and processing means suitable for detecting any bunching of the flat articles on the basis of the images.

The basic idea of the invention is to provide detector means between an upstream conveyor transporting the flat articles without nipping them and a downstream conveyor transporting the flat articles with them being nipped. Thus, the detector means may operate independently on the basis of flat articles referenced in the height direction. The detector means are also designed to detect bunching while the flat articles are being conveyed without them being nipped, thereby making image capture and bunching detection easier and more reliable. The flat articles being sucked to either side of the passage zone makes it possible to separate them laterally without any shear force being exerted, the distance between them making it easier for them to be detected in differentiated manner.

The sorting machine of the invention may advantageously have the following features:

- the upstream conveyor is provided with side upstream belts that face each other and with a bottom belt, and it is arranged to convey the flat articles without nipping them, the flat articles being referenced in the height direction on the bottom belt;
- the upstream belts of the upstream conveyor are spaced apart from each other by a first distance, and the intermediate belts are spaced apart from each other by a second distance substantially equal to or greater than said first distance;
- the first and second distances are fixed and lie in the range 15 millimeters (mm) to 30 mm, the first distance preferably being substantially equal to 18 mm and the second distance preferably being substantially equal to 22 mm;
- the intermediate conveyor is arranged so that the intermediate belts are caused to move simultaneously at speeds that are substantially mutually similar;
- the suction means are arranged so that the suctions of the respective intermediate belts are substantially mutually similar;
- the bottom belt extends over at least a fraction of the length of said intermediate belts so as to support the bottoms of said flat articles while also providing a zone of sight for said image capture means in the downstream portion of said passage zone;
- the suction means are arranged so as to apply suction over only a limited height of the bottom portion of the intermediate belts;
- said image capture means include a matrix-array camera equipped with light-emitting diode (LED) lighting;
- the upstream edge of one suction means is offset upstream from said intermediate belts relative to the upstream edge of the other suction means;
- the suction means are arranged so as to generate suction of in the range 10 mbar to 12 mbar on each of the intermediate belts with a flow rate of at least about 150 cubic meters per hour ($m^3/h$) and less than about 600 $m^3/h$; and
- the passage zone separating the intermediate belts is covered with a protective plate arranged to limit the aerodynamic disturbance in the passage zone.

BRIEF DESCRIPTION OF THE DRAWING

The present invention can be better understood and other advantages appear on reading the following detailed description of an embodiment given by way of non-limiting example and with reference to the accompanying drawings, in which.

DESCRIPTION OF THE EMBODIMENTS

Figure 1:
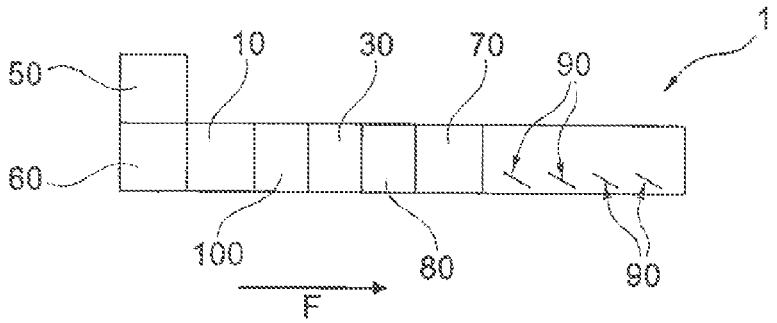
FIG. 1 is a diagrammatic plan view of a sorting machine of the invention.

With reference to FIG. 1, the sorting machine 1 of the invention includes, in succession, a storage magazine 50 for storing flat articles, an unstacker 60 suitable for unstacking the stacked flat articles and for putting them in series, an upstream conveyor 10 for conveying the flat articles, a downstream conveyor 30, a decoding system 70 for decoding addresses on the flat articles, and sorting outlets 90 suitable for receiving the flat articles in compliance with a predetermined sorting plan as a function of the previously decoded addresses, and for stacking them. The sorting machine 11 further includes detector means 100 for detecting bunching of flat articles, which detector means are disposed between the upstream conveyor 10 and the downstream conveyor 30. The sorting machine 1 may further include either removal means, of known type, suitable for removing the flat articles that are detected as bunching by the detector means 100, or separator means 80, also of known type, for separating said flat articles that are detected as bunching. Additional conveyor means may also be provided between the elements of the sorting machine 1 and the sorting machine 1 may include any other suitable equipment.

Figure 2:
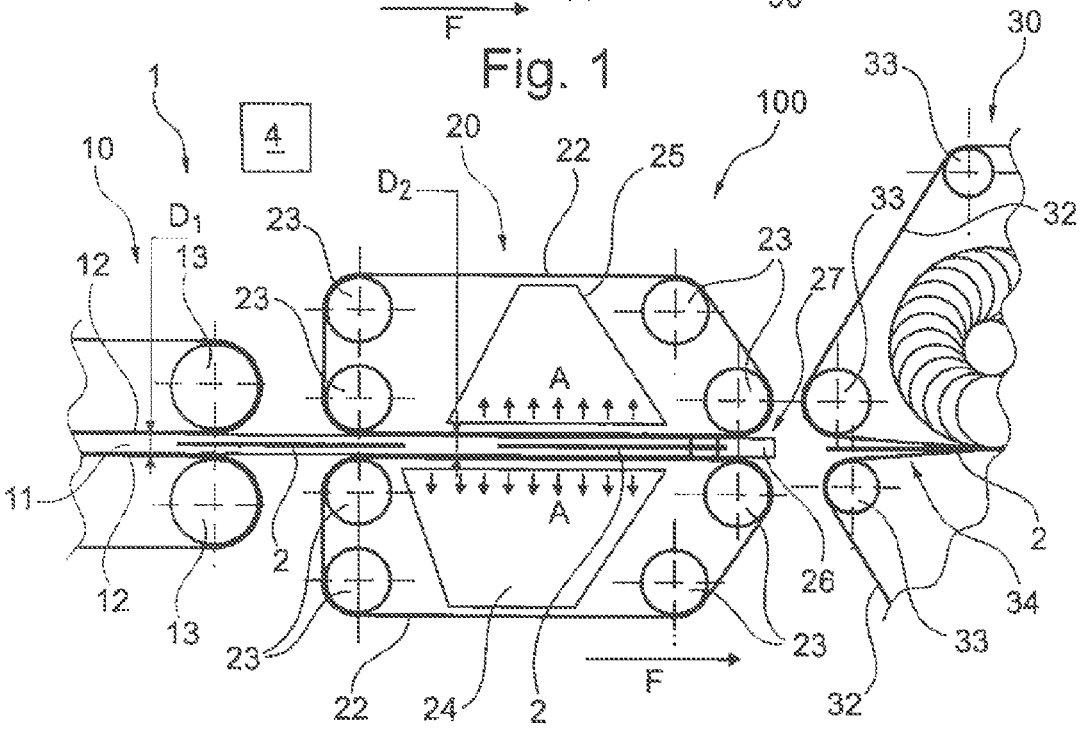
FIG. 2 is a fragmentary plan view of the sorting machine of FIG. 1.

With reference to FIG. 2, the upstream conveyor 10, or "stabilization conveyor" as it can be called, includes a bottom belt 11 on which the flat articles 2 stand, and that is suitable for conveying the flat articles 2 towards the downstream end of the sorting machine 1 in the longitudinal direction F. It further includes side upstream belts 12 carried by upstream pulleys 13 and disposed facing each other, substantially perpendicular to the bottom belt 11. The upstream belts 12 are substantially parallel to each other and spaced apart from each other by a first distance D1 within which the flat articles 2 can be received without being nipped. The first distance D1 is fixed and lies in the range 15 mm to 30 mm, and is preferably substantially equal to 18 mm. This first distance D1 is thus greater than the thickness of two flat articles 2 that are bunched together. Thus, the upstream belts 12 accompany the flat articles 2 without nipping them as they move on the bottom belt 11 in the longitudinal direction F, regardless of whether they are traveling singly or in bunches. The flat articles 2 are placed freely referenced in the height direction, with their bottoms bearing on the bottom belt 11. They are thus settled and stabilized in the height direction, thereby facilitating subsequent detection of bunching.

The downstream conveyor 30 includes downstream belts 32 carried by downstream pulleys 33 disposed facing each other and brought towards each other so as to form a nip point 34 for nipping the flat articles 2. The flat articles 2 nipped in this way are driven in controlled manner. The downstream conveyor 30 may be followed by removal means (not shown) suitable for removing the flat articles 2 detected as bunching by the detector means 100 described below. The downstream conveyor 30 may also be followed by separator means 80 suitable for separating the flat articles 2 that are bunching, e.g. by accelerating one of the flat articles 2 relative to another so as to form a longitudinal gap between them so as to transform the bunched articles into single articles. The separator means 80 are followed by the sorting outlets 90, which are shown diagrammatically in FIG. 1 and between which the flat articles 2 are distributed and stacked in compliance with a predetermined sorting plan.

The detector means 100 are provided between the upstream conveyor 10 and the downstream conveyor 30. They include an intermediate conveyor 20, suction means 24, 25, image capture means 26, and image analysis and processing means represented diagrammatically by the block referenced 4 in FIG. 2.

The intermediate conveyor 20 includes perforated side intermediate belts 22, carried by intermediate pulleys 23 and disposed facing each other, substantially in alignment with the downstream belts 12 so as to define a passage zone 27. The speeds of each intermediate belt 22 are chosen to be mutually identical, e.g. 4 meters per second (m/s). The intermediate belts 22 are spaced apart from each other by a second distance D2 within which the flat articles 2 can be received without being nipped. The second distance D2 is equal to or greater than the first distance D1, and is preferably substantially equal to 22 mm. For example, the intermediate belts 22 extend over a length of at least about 190 mm, and are provided with perforations (not shown in detail) allowing air to pass through them. This minimum length enables the suction described below to be fully effective in separating the flat articles 2 laterally from one another and in guaranteeing reliable detection of bunching. The above-described bottom belt 11 that extends along the downstream belts 12 also extends along a fraction of the intermediate belts 22. Thus, the intermediate belts 22 accompany the flat articles 2 without nipping them as they move on the bottom belt 11 in the longitudinal direction F. The bottom belt 11 does not extend to the downstream ends of the intermediate belts 22 in order to preserve a window of sight for the detector means that are described below. This window of sight is thus provided facing the passage zone 27 through which the flat articles 2 pass.

Each intermediate belt 22 is associated with suction means 24, 25 suitable for generating suction through the perforations in the intermediate belt 22, as indicated by the transverse arrows A. Thus, when the flat articles 2 travel one-by-one between the intermediate belts 22, each of them is individually pressed by suction towards the intermediate belt 22 to which it is closer. When bunching is present at the entrance to the passage zone 27, one of the flat articles 2 is pressed by suction against one of the intermediate belts 22, and the other flat article 2 is pressed by suction against the other of the intermediate belts 22. Thus, the bunched flat articles 2 are temporarily separated laterally. The suction means 24, 25 preferably include two vacuum pumps of conventional type (not shown), connected to two suction chambers that are independent from each other and that extend behind respective ones of the intermediate belts 22 relative to the passage zone 27. The fact that the suction means 24, 25 are independent from each other in terms of suction power makes it possible, in the event of bunching, to ensure that one of the flat articles 2 being pressed against one of the intermediate belts 22 does not increase the suction through the other intermediate belt 22, which can thus be effective in applying suction to the other flat article 2 and in pressing said article against it without interfering with the pressing of the first flat article 2. In advantageous manner, the suction means 24, 25 are arranged so that identical suction is applied through both of the intermediate belts 22. The suction means 24, 25 are controlled to act simultaneously and to generate suction of in the range 10 millibars (mbar) to 12 mbar on each of the intermediate belts 22, preferably with a flow rate of about 150 $m^3/h$, it being possible for the flow rate to be higher so long as it does not exceed a limit of about 600 $m^3/h$, beyond which the aerodynamic disturbance in the suction zone adversely affects the effectiveness of the pressing of each of the two flat articles 2 that are bunched together against the respective ones of the intermediate belts 22. The suction means 24, 25 are also arranged so that the suction through the intermediate belts 22 has an impact over a limited height only, namely over the bottom portion of the intermediate belts 22, e.g. in the range 25 mm above the bottom belt 11 to 100 mm therebove. To this end, it is possible to provide suction inlets of limited height and/or intermediate belts 22 in which the perforations extend over only a fraction of their height. This particular configuration makes it possible to limit the aerodynamic disturbance that is detrimental to the flat articles 2 being presented properly above the image capture means that are described below. In addition, the passage zone 27 underlies a preferably horizontal protective plate (not shown) that makes it possible to limit the aerodynamic disturbance in the passage zone 27. This protective plate is advantageously transparent over most of its length so that the flat articles 2 passing through the passage zone 27 remain visible to the operator, and opaque above the image capture means described below, so as not to disturb detection of bunching. Finally, the suction means 24 and 25 are advantageously offset relative to each other in the longitudinal direction F. The upstream edge of the suction means 25 is thus provided downstream from the upstream edge of the suction means 24. This configuration facilitates pressing the first flat article 2 entering the passage zone 27 against the intermediate belt 22 on the side on which suction is ahead, namely on the same side as the suction means 24. In the event of bunching, the first of the two flat articles 2 that, due to the design of the unstacker 60, is in most cases situated on the same side as the suction means 24, is pressed against the intermediate belt 22 on the same side, and leaves the second flat article 2 free so that it comes more easily to be pressed against the other intermediate belt 22 on the same side as the suction means 25.

Figure 3:
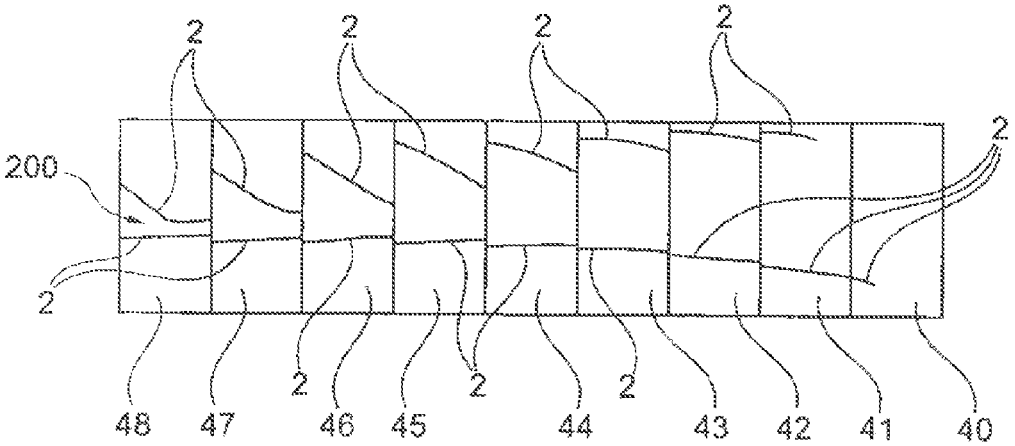
FIG. 3 is a diagram representing a succession of images captured by the image capture means of the detector means of the sorting machine of the invention.

The detection means 100 further include lighting means, such as, for example, one (or more) white LEDs that are not shown, and image capture means, in particular a camera 26 disposed facing the window of sight, e.g. having a length of approximately in the range 40 mm to 45 mm and a width of about 22 mm. The LED lighting is of known type. The use of such a type of lighting is made possible by previously bringing the bottoms of the flat articles 2 into reference against the bottom belt 11. The zone of sight of the camera 26 is provided in the downstream portion of the passage zone 27, at the exit from the intermediate belts 22 and suitable for covering the entire width of the passage zone 27. Thus, the camera 26 can capture the image of the edge of any flat article 2 passing through the passage zone 27. In addition, by means of the particular location of the camera 26, any bunched flat articles 2 have enough time to be sucked and pressed to either side of the passage zone 27 against the intermediate belts 22 before they reach the zone of sight of the camera 26. In this way, the camera 26 can capture an accurate image of the edge of each of the flat articles 2, thereby making detection of bunching easier and more reliable. In advantageous manner, a matrix-array camera 26 is used, such a camera being less costly than a linear-array camera and making it possible for image capture to be non-deformed and without any artifact related to the movement of the flat articles through the conveyor during the image acquisition, allowing analysis to be reliable. The camera 26 may be carried by a pivotally mounted support (not shown) enabling it to be retracted, in particular for cleaning and/or maintenance operations. The fact that the flat articles 2 are previously settled in the height direction against the bottom belt 11 enables the focusing of the camera 26 to be set accurately so that said camera can obtain an image that is clear and usable without needing to be adjusted each time a new flat article 2 arrives in the passage zone 27, and, for the same reason, it is not necessary to have either a large depth of field or a large range for the lighting. Similarly, the bunched flat articles 2 being laterally separated by being pressed by suction to either side of the passage zone 27 against the intermediate belts 22 enables them to be better detected by the camera 26. FIG. 3 shows an example of successive image captures 40-48 of two bunched flat articles 2 passing through the passage zone 27. For example, the images 40-48 are taken at regular time intervals, at a frequency of 100 images per second with a resolution of 4 dots per millimeter (dpmm) in the length direction and of 16 dpmm in the width direction. Image capture can be triggered on detecting the presence of a flat article 2. These images 40-48 make it possible to analyze more finely the dynamic behavior of the flat article(s) 2 passing through the passage zone 27 above the window of sight. The behavior of the bunched flat articles 2 separated laterally for making it easier to detect them can thus be observed in FIG. 3. The detection means 100 also include image analysis and processing means 4 suitable for detecting any bunching of flat articles 2 on the basis of the images 40-48. The image analysis and processing means 4 can take advantage of the variation in distance between the trace of the two bunched flat articles 2 due to them being sucked and pressed against the intermediate belts 22. The image analysis and processing means 4 may, for example, have their parameters set to detect the cone 200 formed by the flat articles 2 coming together by being forced by the downstream conveyor 30 provided after the intermediate conveyor 20. Once the bunched flat articles 2 have been separated laterally by means of the suction through the intermediate belts 22, they are, once again, pressed against each other at the nip point 34 of the downstream conveyor 30, thereby bunching again, this bunching being handled further downstream in the sorting machine 1.

In a variant embodiment (not shown), the bottom belt extends along the downstream belts only and is followed by a smooth slide bed that extends along the intermediate belts, while also preserving the window of sight. In this situation, the nominal speed of the flat articles is maintained by means of the intermediate belts sucking the flat articles against them and driving them.

The invention makes it possible to achieve the above-mentioned objectives. The sorting machine 1 of the invention enables detection of bunching of flat articles 2 to be made more reliable so that such bunching can be handled in dissociated manner further downstream. Systematically physically separating bunched flat articles makes it possible to reduce the rate of erroneous detections of bunching, such erroneous detections being frequent with flat articles 2 containing a plurality of brochures wrapped in transparent flexible plastic. In particular, the second distance D2 between the intermediate belts 22 makes it possible to prevent the plastics wrapping of such flat articles 2 from being pressed on either side against respective ones of the intermediate belts 22. Detection of bunching performed on flat articles 2 that are separated laterally is much easier compared with detection performed on flat articles that are being nipped.

Naturally, the present invention is in no way limited to the above description of one of its embodiments, which can undergo modifications without going beyond the ambit of the invention.

The invention claimed is:

1. A sorting machine for sorting flat articles on edge, which machine includes an upstream conveyor, a downstream conveyor that is provided with side downstream belts facing each other and that is arranged to convey said flat articles by nipping them, and detector means for detecting bunching of said flat articles, said sorting machine being characterized in that said detector means are provided between said upstream conveyor and said downstream conveyor and include:

an intermediate conveyor provided with side perforated intermediate belts facing each other and arranged to convey said flat articles without nipping them;

suction means associated individually with said intermediate belts and suitable for generating suction at each of said intermediate belts, which suction is suitable for pressing any flat article traveling between said intermediate belts against one or the other of said intermediate belts;

image capture means suitable for capturing images of the edges of said flat articles passing between said intermediate belts, said image capture means being disposed facing the passage zone defined by said intermediate belts, in the downstream portion of said passage zone at the exit from the intermediate belts; and image analysis and processing means suitable for detecting any bunching of said flat articles on the basis of said images.

2. The sorting machine according to claim 1, characterized in that said upstream conveyor is provided with side upstream belts that face each other and with a bottom belt, and in that it is arranged to convey said flat articles without nipping them, said flat articles being referenced in the height direction on said bottom belt.

3. The sorting machine according to claim 2, characterized in that said upstream belts of said upstream conveyor are spaced apart from each other by a first distance, and in that said intermediate belts are spaced apart from each other by a second distance substantially equal to or greater than said first distance.

4. The sorting machine according to claim 3, characterized in that said first and second distances are fixed and lie in the range 15 mm to 30 mm.

5. The sorting machine according to claim 1, characterized in that said intermediate conveyor is arranged so that said intermediate belts are caused to move simultaneously at speeds that are substantially mutually similar.

6. The sorting machine according to claim 1, characterized in that said suction means are arranged so that the suctions of the respective intermediate belts are substantially mutually similar.

7. The sorting machine according to claim 2, characterized in that said bottom belt extends over at least a fraction of the length of said intermediate belts so as to support the bottoms of said flat articles while also providing a zone of sight for said image capture means in the downstream portion of said passage zone.

8. The sorting machine according to claim 1, characterized in that said suction means are arranged so as to apply suction over only a limited height of the bottom portion of said intermediate belts.

9. The sorting machine according to claim 1, characterized in that said image capture means include a matrix-array camera equipped with LED lighting.

10. The sorting machine according to claim 1, characterized in that the upstream edge of one suction means is offset upstream from said intermediate belts relative to the upstream edge of the other suction means.

11. The sorting machine according to claim 1, characterized in that said suction means are arranged so as to generate suction of in the range 10 mbar to 12 mbar on each of said intermediate belts with a flow rate of at least about 150 $m^3/h$ and less than about 600 $m^3/h$.

12. The sorting machine according to claim 1, characterized in that the passage zone separating said intermediate belts is covered with a protective plate arranged to limit the aerodynamic disturbance in said passage zone.

13. The sorting machine according to claim 2, characterized in that said first distance is substantially equal to 18 mm and said second distance is substantially equal to 22 mm.

* * * * *